US006692687B2

(12) United States Patent
Chang et al.

(10) Patent No.: US 6,692,687 B2
(45) Date of Patent: Feb. 17, 2004

(54) METHOD FOR HIGH-SPEED SPINNING OF BICOMPONENT FIBERS

(75) Inventors: Jing Chung Chang, Columbia, SC (US); Joseph V. Kurian, Newark, DE (US); Young D. Nguyen, Singapore (SG), SGX; James E. Van Trump, Wilmington, DE (US); George Vassilatos, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 197 days.

(21) Appl. No.: 09/758,309

(22) Filed: Jan. 11, 2001

(65) Prior Publication Data

US 2002/0025433 A1 Feb. 28, 2002

Related U.S. Application Data

(63) Continuation-in-part of application No. 09/708,314, filed on Nov. 8, 2000, now abandoned, which is a continuation-in-part of application No. 09/488,650, filed on Jan. 20, 2000, now abandoned.

(51) Int. Cl.[7] ..... D01D 5/098; D01D 5/32; D01D 5/34

(52) U.S. Cl. ..... 264/555; 264/168; 264/172.14; 264/172.15; 264/172.17; 264/210.5; 264/210.8; 264/211.12; 264/211.14; 264/211.17; 264/235.6

(58) Field of Search ..... 264/168, 172.14, 264/172.15, 172.17, 210.5, 210.8, 211.12, 211.14, 211.17, 235.6, 555

(56) References Cited

U.S. PATENT DOCUMENTS

| | | | | |
|---|---|---|---|---|
| 3,454,460 A | | 7/1969 | Bosely | |
| 3,536,763 A | | 10/1970 | Elenterio et al. | |
| 3,671,379 A | | 6/1972 | Evans et al. | |
| 4,115,989 A | | 9/1978 | Spolnicki | |
| 4,217,321 A | | 8/1980 | Campbell | |
| 4,405,686 A | | 9/1983 | Kuroda et al. | |
| 4,424,258 A | * | 1/1984 | Bach | 264/168 X |
| 4,687,610 A | | 8/1987 | Vassilatos | |
| 4,691,003 A | | 9/1987 | Sze | |
| 5,034,182 A | | 7/1991 | Sze | |
| 5,171,898 A | | 12/1992 | Arntz et al. | |
| 5,824,248 A | | 10/1998 | Sweet et al. | |
| 6,306,499 B1 | | 10/2001 | Ochi et al. | |
| 2001/0055683 A1 | | 12/2001 | Ochi et al. | |

FOREIGN PATENT DOCUMENTS

JP 10331075 A 12/1998

OTHER PUBLICATIONS

Anonymous disclosure, RD–173047–A, Sep. 10, 1978.*
Translation of JP–61032404–B2 (Jul. 26, 1986).*
Translation of JP–09087922–A (Mar. 31, 1997).*
Translation of JP–11189923–A (Jul. 13, 1999).*
Translation of WO 95/15409A1 (Jun. 8, 1995).*

* cited by examiner

*Primary Examiner*—Leo B. Tentoni

(57) ABSTRACT

Highly crimped, fully drawn bicomponent fibers, prepared by melt-spinning, followed by gas-flow quenching, heat treatment and high speed windup, are provided, as are fine-decitex and highly uniform polyester bicomponent fibers.

19 Claims, 9 Drawing Sheets

METHOD FOR HIGH-SPEED SPINNING OF BICOMPONENT FIBERS

CROSS-REFERENCE TO RELATED APPLICATIONS

This application is a continuation-in-part of application Ser. No. 09/708,314, filed Nov. 8, 2000, now abandoned, which in turn is a continuation-in-part of application Ser. No. 09/488,650, filed Jan. 20, 2000, now abandoned.

BACKGROUND OF THE INVENTION

1. Field of the Invention

This invention relates to a process for preparing fully drawn bicomponent fibers at high speeds and, more particularly, to a process of extruding two polyesters from a spinneret, passing the fibers through a cooling gas, drawing, heat-treating, and winding up the fibers at high speeds.

2. Description of Background Art

Synthetic bicomponent fibers are known. U.S. Pat. No. 3,671,379 discloses such fibers based on poly(ethylene terephthalate) and poly(trimethylene terephthalate). The spinning speeds disclosed in this reference are uneconomically slow. Japanese Patent Application Publication JP11-189923 and Japanese Patent JP61-32404 also disclose the use of copolyesters in making bicomponent fibers. U.S. Pat. No. 4,217,321 discloses spinning a bicomponent fiber based on poly(ethylene terephthalate) and poly(tetramethylene terephthalate) and drawing it at room temperature and low draw ratios. Such fibers, however, have low crimp levels, as do the polyester bicomponent fibers disclosed in U.S. Pat. No. 3,454,460.

Several apparatuses and methods have been proposed for melt-spinning partially oriented monocomponent fibers at high speeds, as disclosed in U.S. Pat. Nos. 4,687,610, 4,691,003, 5,034,182, and No. 5,824,248 and in International Patent Application WO95/15409. Generally, in these methods a cooling gas is introduced into a zone below the spinneret and accelerated in the travel direction of the newly formed fibers. However, such fibers do not crimp spontaneously and, therefore, do not have desirable high stretch-and-recovery properties.

An economical process for making highly crimpable polyester bicomponent fibers is still needed.

SUMMARY OF THE INVENTION

The process of the present invention for preparing fully drawn crimped bicomponent fibers, having after-heat-set crimp contraction values above about 30%, comprises the steps of:

(A) providing two compositionally different polyesters;

(B) melt-spinning the two polyesters from a spinneret to form at least one bicomponent fiber;

(C) providing at least one flow of gas to at least one quench zone below the spinneret and accelerating the gas flow to a maximum velocity in the direction of fiber travel;

(D) passing the fiber through said zone(s);

(E) withdrawing the fiber at a withdrawal speed such that the ratio of the maximum gas velocity to the withdrawal speed is so chosen to achieve a specific draw ratio range;

(F) heating and drawing the fiber at a temperature of about 50–185° C. at a draw ratio of about 1.4–4.5;

(G) heat-treating the fiber by heating it to a temperature sufficient to result in an after-heat-set contraction value above about 30%; and (H) winding up the fiber at a speed of at least about 3,300 meters per minute.

Another process of the present invention for preparing fully drawn bicomponent fibers, having after-heat-set crimp contraction values above about 30%, comprises the steps of:

(A) providing poly(ethylene terephthalate) and poly (trimethylene terephthalate) polyesters having different intrinsic viscosities;

(B) melt-spinning said polyesters from a spinneret to form at least one bicomponent fiber having either a side-by-side or eccentric sheath core cross-section;

(C) providing a flow of gas to a quench zone below the spinneret;

(D) passing the fiber through the quench zone;

(E) withdrawing the fiber;

(F) heating and drawing the fiber to a temperature of about 50–185° C. at a draw ratio of about 1.4–4.5;

(G) heat-treating the fiber by heating it to a temperature sufficient to result in an after-heat-set contraction value above about 30%; and (H) winding up the fiber at a speed of at least about 3,300 meters per minute.

The bicomponent fiber of this invention is of about 0.6–1.7 dtex/filament, the fiber having after-heat-set crimp contraction values of at least 30% and comprising poly (trimethylene terephthalate) and a polyester selected from the group consisting of poly(ethylene terephthalate) and copolyesters of poly(ethylene terephthalate), having a side-by-side or eccentric sheath core cross-section and a cross-sectional shape which is substantially round, oval or snowman.

DETAILED DESCRIPTION OF THE INVENTION

It has now been found surprisingly that bicomponent fibers can be spun with either crossflow, radial flow or co-current flow quench gas, withdrawn, fully drawn, and heat-treated at very high speeds to give high crimp levels. It was unexpected that such highly crimped bicomponent fibers can be prepared in view of the high withdrawal speeds and high draw ratios (that is, high windup speeds).

As used herein, "bicomponent fiber" means a fiber comprising a pair of polymers intimately adhered to each other along the length of the fiber, so that the fiber cross-section is for example a side-by-side, eccentric sheath-core or other suitable cross-section from which useful crimp can be developed. "IV" means intrinsic viscosity. "Fully drawn" fiber means a bicomponent fiber which is suitable for use, for example, in weaving, knitting, and preparation of non-wovens without further drawing. "Partially oriented" fiber means a fiber which has considerable but not complete molecular orientation and requires drawing or draw-texturing before it is suitable for weaving or knitting. "Co-current gas flow" means a flow of quench gas which is in the direction of fiber travel. "Withdrawal speed" means the speed of the feed rolls, which are positioned between the quench zone and the draw rolls and is sometimes referred to as the spinning speed. The notation "//" is used to separate the two polymers used in making a bicomponent fiber. "2G" means ethylene glycol, "3G" means 1,3-propane diol, "4G" means 1,4-butanediol, and "T" means terephthalic acid. Thus, for example, "2G-T//3G-T" indicates a bicomponent fiber comprising poly(ethylene terephthalate) and poly (trimethylene terephthalate).

Figure 8:
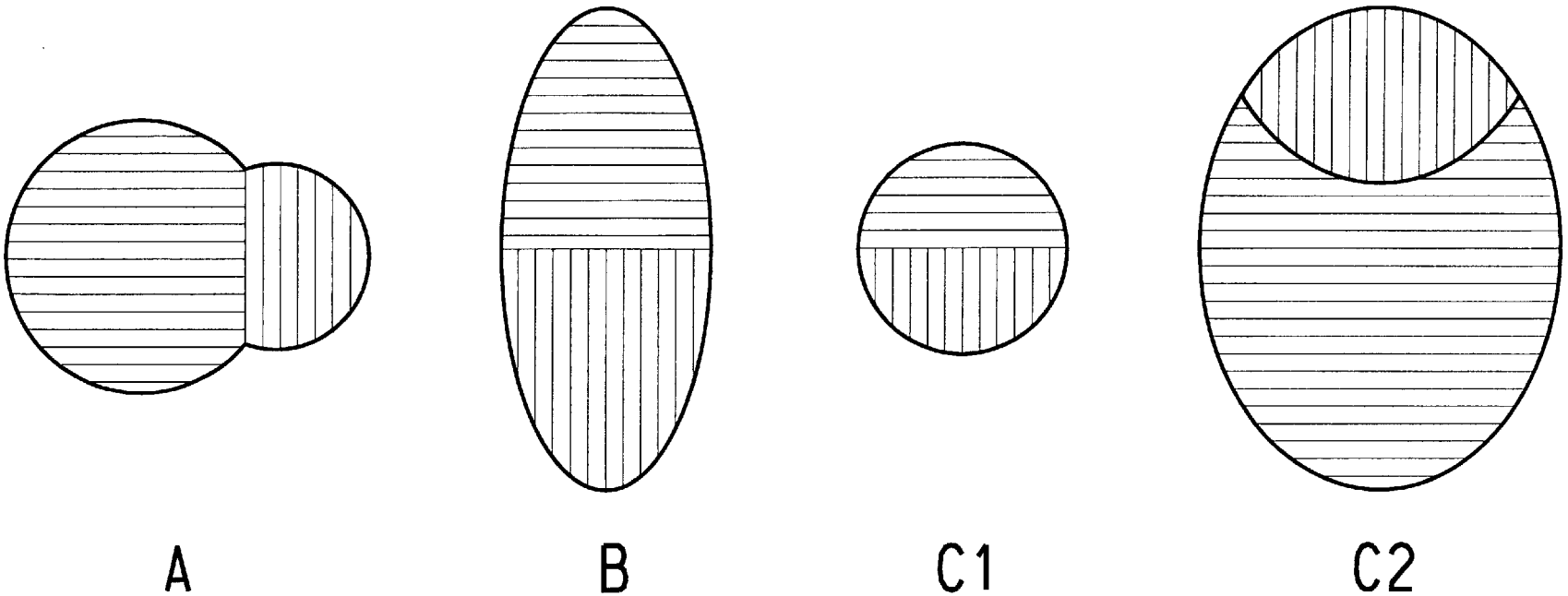
FIG. 8 illustrates examples of cross-sectional shapes that can be made by the process of the invention and of fine-denier(decitex) polyester bicomponent and highly uniform polyester bicomponent cross-sectional shapes of the invention.

In the process of the invention, two compositionally different polyesters are melt-spun from a spinneret to form a bicomponent fiber. The spinneret can have a design such as that disclosed in U.S. Pat. No. 3,671,379. Either post-coalescence (in which the polymers first contact each other after being extruded) or pre-coalescence (in which the polymers first contact each other before being extruded) spinnerets can be used. As illustrated in FIG. 8, side-by-side fibers made by the process of the invention can have a "snowman" ("A"), oval ("B"), or substantially round ("C1", "C2") cross-sectional shape. Eccentric sheath-core fibers can have an oval or substantially round cross-sectional shape. By "substantially round" it is meant that the ratio of the lengths of two axes crossing each other at 90° in the center of the fiber cross-section is no greater than about 1.2:1. By "oval" it is meant that the ratio of the lengths of two axes crossing each other at 90° in the center of the fiber cross-section is greater than about 1.2:1. A "snowman" cross-sectional shape can be described as a side-by-side cross-section having a long axis, a short axis and at least two maxima in the length of the short axis when plotted against the long axis.

Regardless of whether co-current or cross-flow quench gas flow is used, 2G-T can be typically heated to about 280° C. for transfer to the spinneret, while the corresponding temperature for 3G-T can be less than 280° C., with a transfer holdup time up to 15 minutes.

Figure 1:
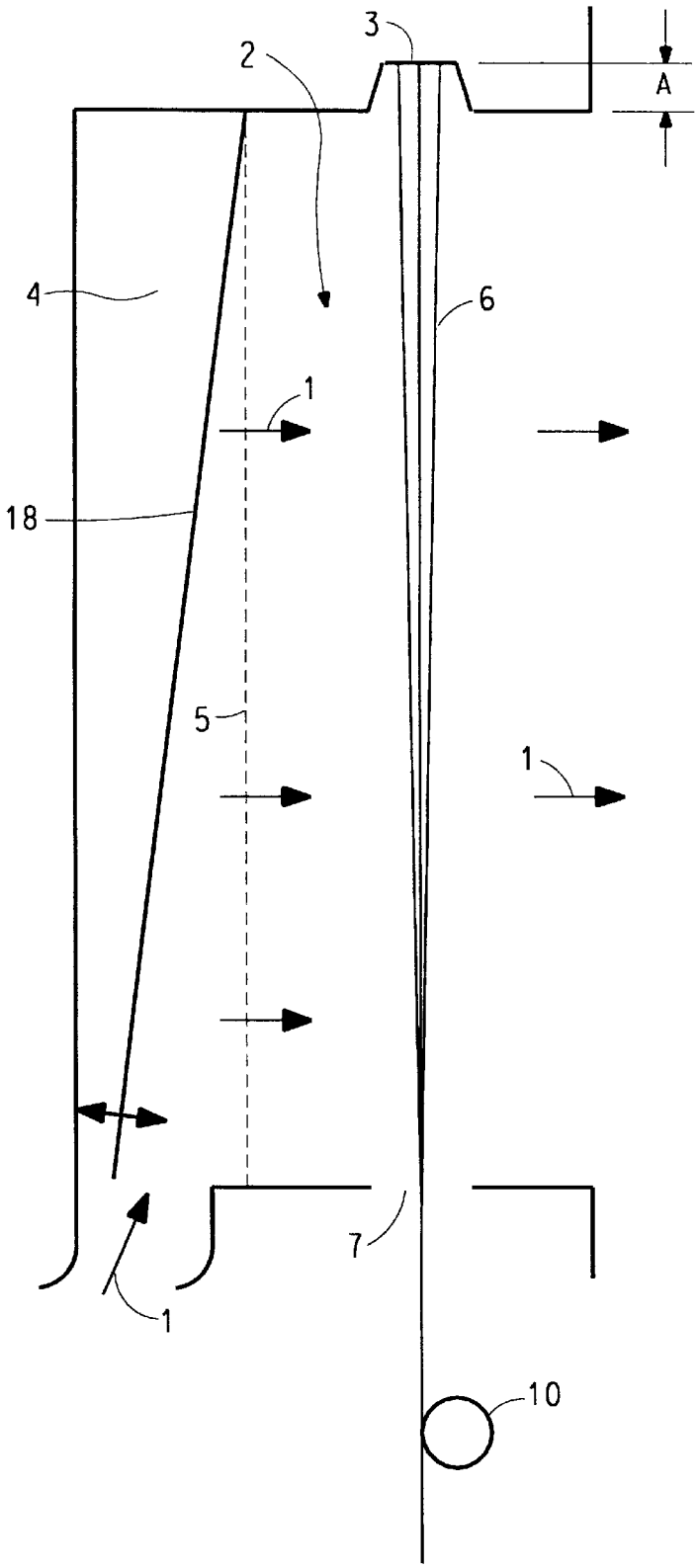
FIG. 1 illustrates a cross-flow quench melt-spinning apparatus useful in the process of the present invention.

FIG. 1 illustrates a crossflow melt-spinning apparatus which is useful in the process of the invention. Quench gas 1 enters zone 2 below spinneret face 3 through plenum 4, past hinged baffle 18 and through screens 5, resulting in a substantially laminar gas flow across still-molten fibers 6 which have just been spun from capillaries (not shown) in the spinneret. Baffle 18 is hinged at the top, and its position can be adjusted to change the flow of quench gas across zone 2. Spinneret face 3 is recessed above the top of zone 2 by distance A, so that the quench gas does not contact the just-spun fibers until after a delay during which the fibers may be heated by the sides of the recess. Alternatively, if the spinneret face is not recessed, an unheated quench delay space can be created by positioning a short cylinder (not shown) immediately below and coaxial with the spinneret face. The quench gas, which can be heated if desired, continues on past the fibers and into the space surrounding the apparatus. Only a small amount of gas can be entrained by the moving fibers which leave zone 2 through fiber exit 7. Finish can be applied to the now-solid fibers by optional finish roll 10, and the fibers can then be passed to the rolls illustrated in FIG. 3.

Figure 2:
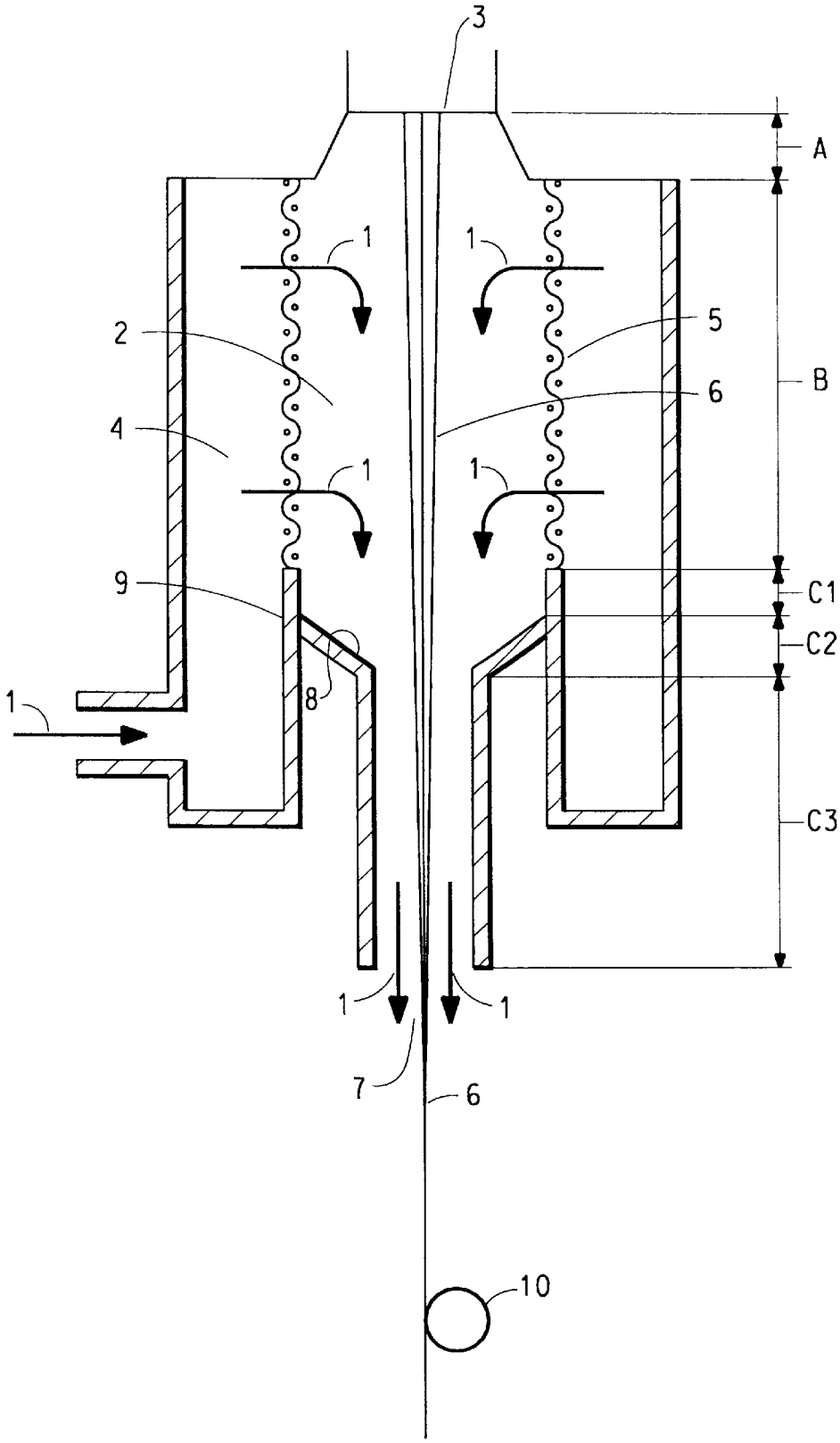
FIG. 2 illustrates a co-current, superatmospheric quench melt-spinning apparatus useful in the process of the present invention (as shown in U.S. Pat. No. 5,824,248, FIG. 2).

Various methods of providing co-current quench gas flow can be used in the present invention. Referring to FIG. 2 for example, fibers 6 are melt-spun into zone 2 from optionally recessed spinneret face 3. Using a recessed spinneret face creates a heated "quench delay" space, typically identified by its length. If the spinneret face is not recessed, and a short cylinder (not shown) is positioned coaxially below the spinneret face, an unheated quench delay space can be created. Quench gas 1, for example, air, nitrogen, or steam, enters quench zone 2 below spinneret face 3 through annular plenum 4 and cylindrical screen 5. When the gas is air or nitrogen, it can be used for example at room temperature, that is, about 20° C. or it can be heated, for example to 40° C.; the relative humidity of the gas is typically about 70%. Tube 8, which at its upper end can be conical as illustrated, is sealed to inner wall 9 of plenum 4 and provides the only outlet for quench gas 1 and fibers 6. The pressure of the quench gas introduced into zone 2 and the constriction provided by tube 8 create a superatmospheric pressure in zone 2, for example in the range of about 0.5–5.0 inches of water (about $1.3\times10^{-3}$ to $1.3\times10^{-2}$ kg/cm$^2$), more typically about 0.5–2.0 inches of water (about $1.3\times10^{-3}$–$5.1\times10^{-3}$ kg/cm$^2$). The pressure used depends on the geometry of the quench chamber and the withdrawal speed of the fiber The quench gas can be introduced from above, for example, from an annular space around the spinneret, or from the side, as shown in FIG. 2 of U.S. Pat. No. 5,824,248. Introduction from the side is preferred to allow better contact of the gas with the fibers for better cooling. The fibers and quench gas are passed through zone 2 below the spinneret to exit 7, the quench gas being accelerated in the direction of fiber travel due to the constriction of tube 8. The maximum velocity of the quench gas is at the narrowest point of the tube. When a tube having a minimum inner diameter of one inch (2.54 cm) is used, the maximum gas velocity can be in the range of about 330–5,000 meters/minute. The ratio of maximum gas velocity to the withdrawal speed of the fiber in the present invention is so chosen that the fiber can be drawn between the feed roll and draw roll at a draw ratio of about 1.4–4.5 at a temperature of about 50–185° C. Having been sufficiently cooled by the quench gas to solidify, fibers 6 can then be contacted by optional finish roll 10 and passed to the rolls illustrated in FIG. 3.

Figure 3:
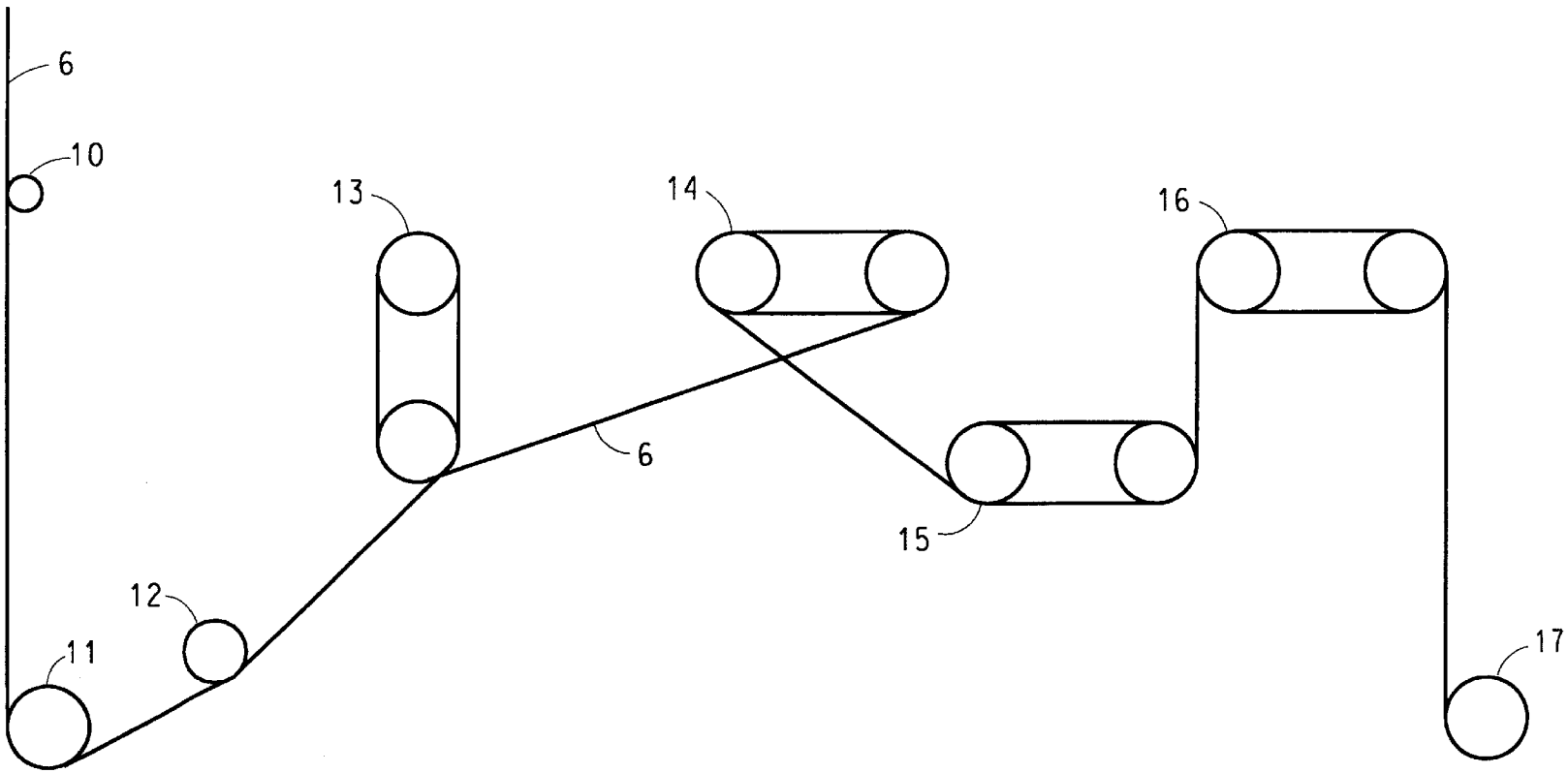
FIG. 3 illustrates an example of a roll arrangement that can be used in the process of the present invention.
Figure 4:
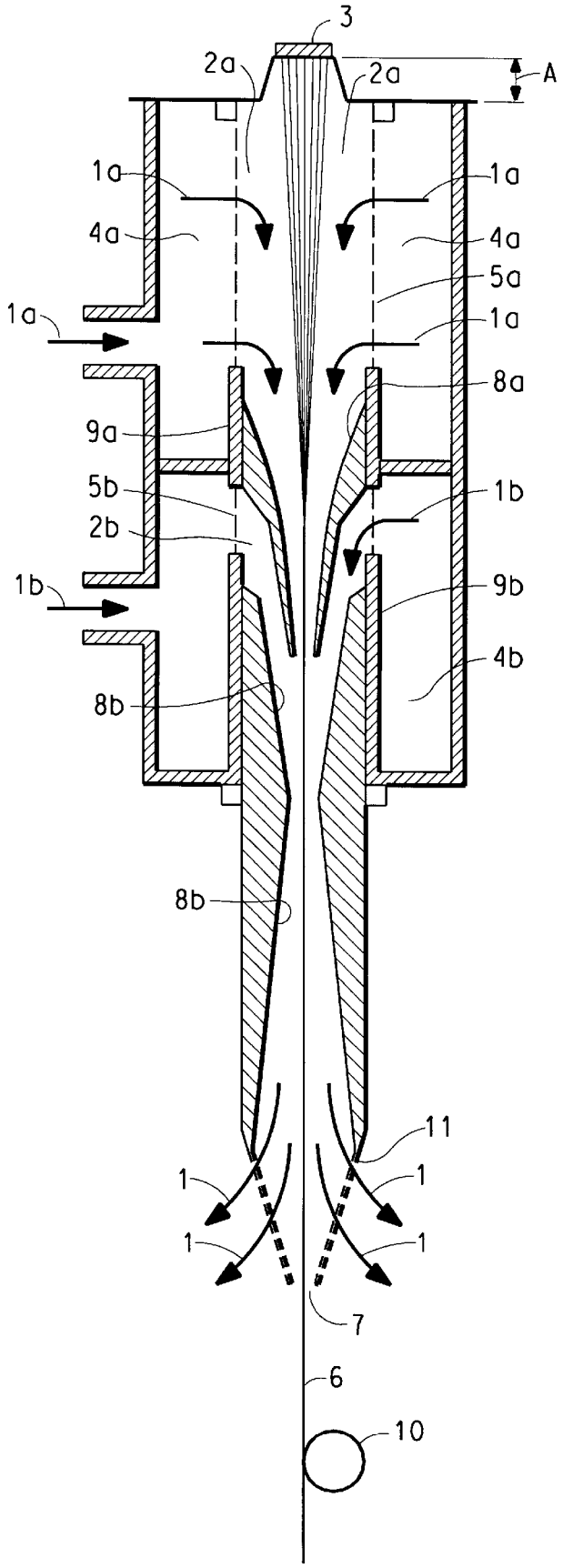
FIG. 4 illustrates a co-current, superatmospheric quench spinning apparatus useful in the process of the present invention, in which two quench zones are used.
Figure 7:
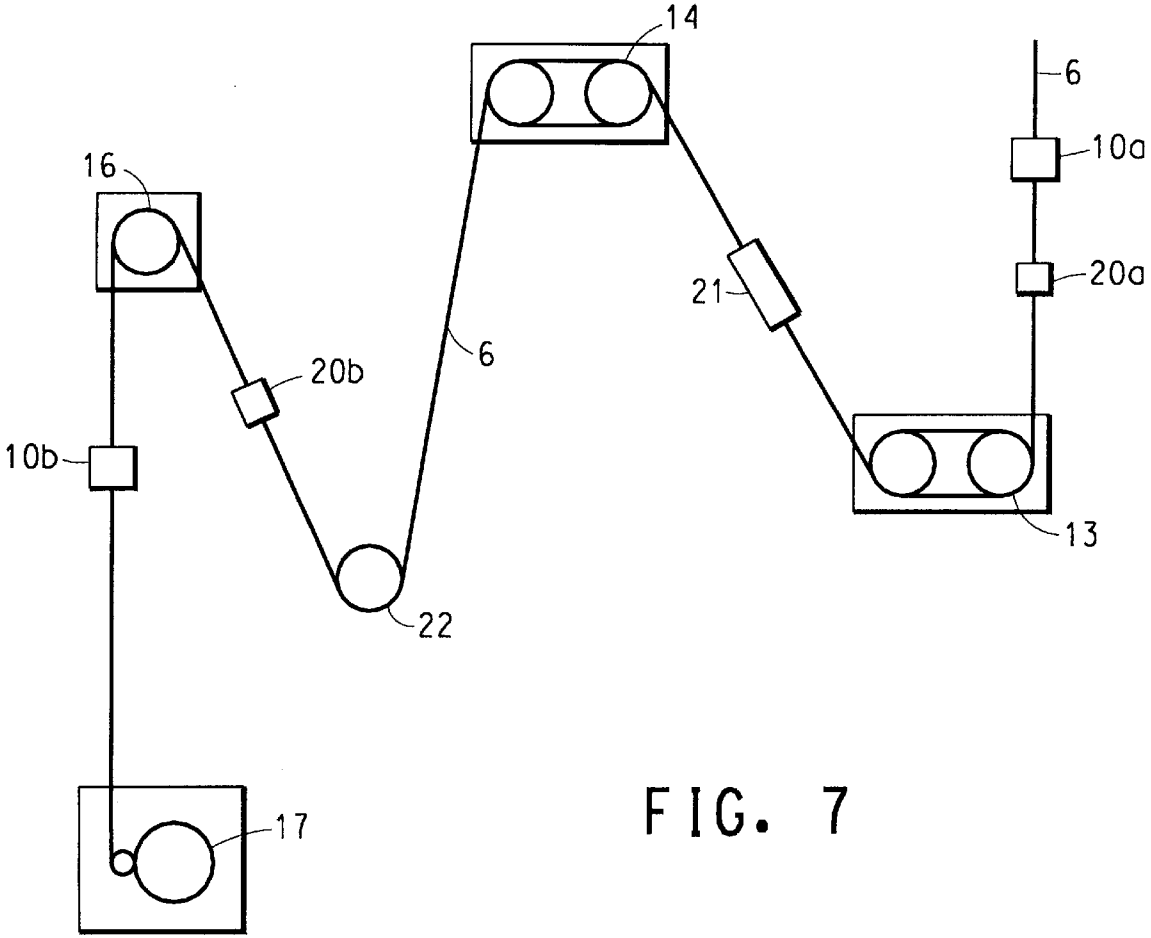
FIG. 7 is a schematic of another embodiment of a roll and jet arrangement that can be used in the process of the invention.
Figure 9:
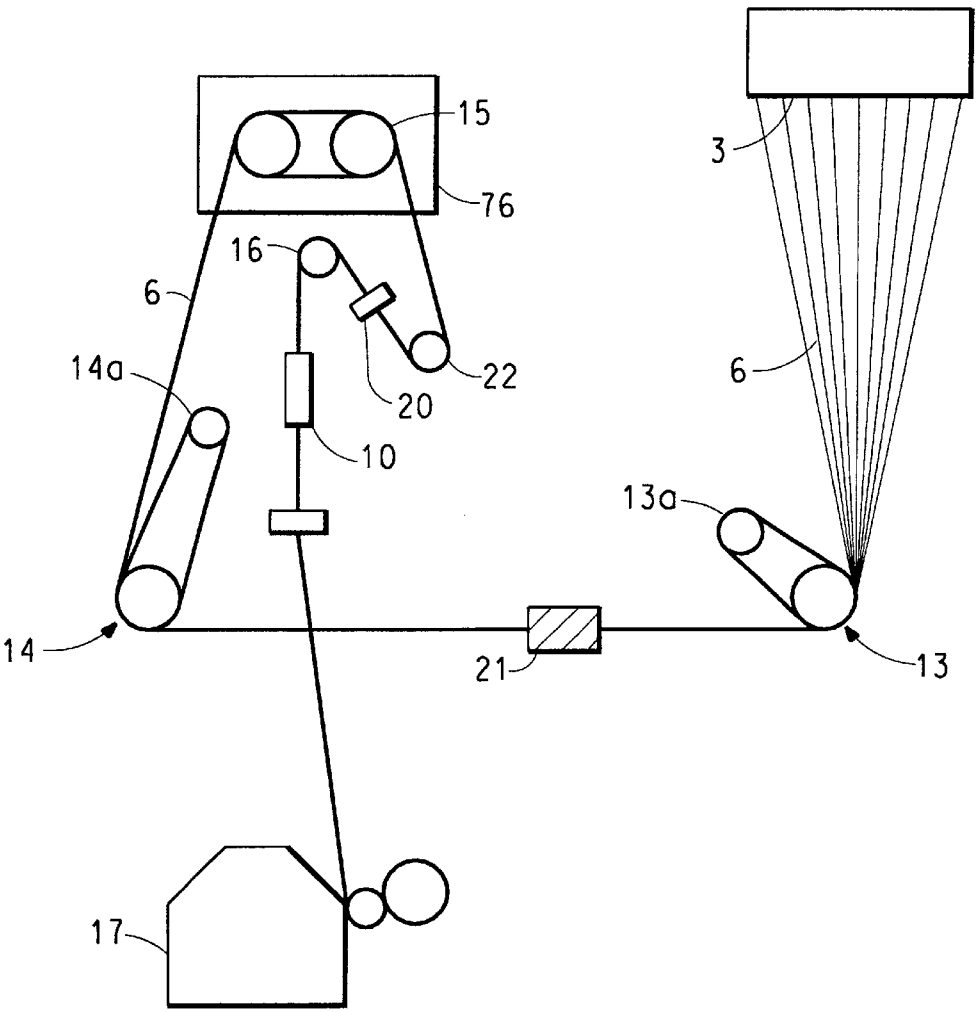
FIG. 9 is a schematic representation of another cross-flow quench system which can be used in the process of the invention.

The process of the present invention can also be carried out with the co-current quench gas flow apparatus shown in FIG. 4. In this process, fibers 6 are melt-spun into zone 2*a* from optionally recessed spinneret face 3. A first flow of quench gas 1*a* enters first quench zone 2*a* below optionally recessed spinneret face 3 through first annular plenum 4*a* and first cylindrical screen 5*a*. First tapered or conical tube 8*a* is connected to first inner wall 9*a* of plenum 4*a*. The inner diameter of tube 8*a* can continually converge as illustrated or can initially converge for a predetermined length and then remain of substantially constant internal diameter. A second flow of quench gas 1*b* enters second quench zone 2*b* through second annular plenum 4*b* through second cylindrical screen 5*b* and is combined in the second quench zone with the first flow of quench gas. Second tube 8*b* is connected to second inner wall 9*b* of plenum 4*b*. As illustrated, the inner diameter of tube 8*b* can initially converge and then diverge; but other geometries can also be used. Quench gas 1 is accelerated in the direction of fiber travel by tubes 8*a* and 8*b* and can then exit through last exit 7 and optional perforated exhaust diffuser cone 11 The maximum gas velocity is at the narrowest point of either tube 8*a* or tube 8*b*, depending on the gas flows 1*a* and 1*b*. Fibers 6 pass through quench zones 2*a* and 2*b*, exit the quench apparatus through fiber exit 7, can then be contacted by optional finish roll 10, and then passed around heating, drawing, and heat-treating rolls and jets, for example as illustrated in FIGS. 3, 7, and 9. The pressure used in the first quench zone is typically higher than that in the second quench zone.

Figure 6:
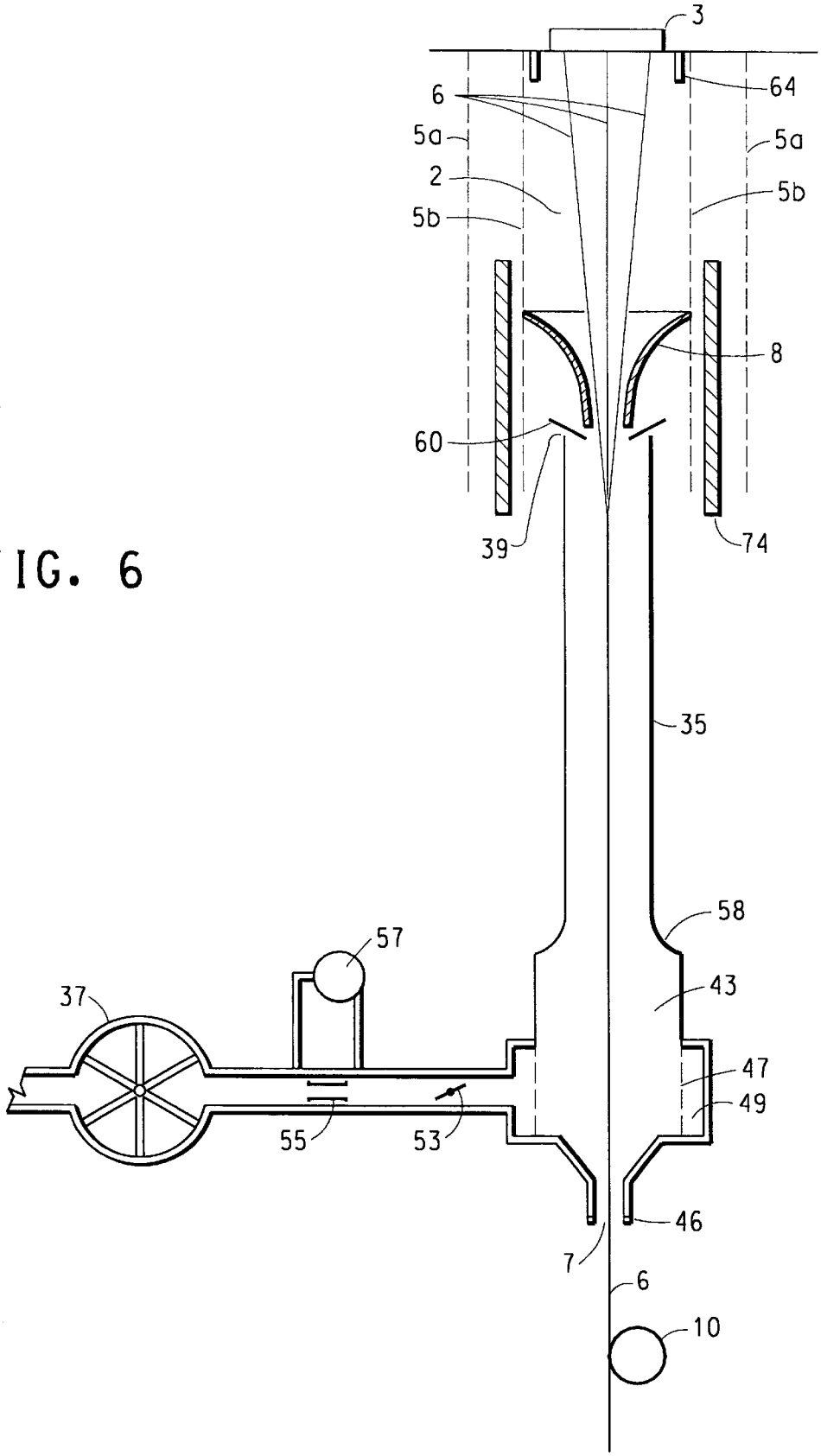
FIG. 6 shows a co-current, subatmospheric quench spinning apparatus useful in the process of the present invention.

The preparation of bicomponent polyester fibers using quench gas which is accelerated in the direction of fiber travel by application of subatmospheric pressure in the zone below the spinneret is also contemplated by the process of the present invention. For example, the apparatus illustrated in FIG. 6 can be used. In FIG. 6, newly formed fibers 6 leave spinneret face 3 and enter quench zone 2. Vacuum source 37 pulls quench gas (for example, room air or heated air) into zone 2 through perforated cylinders 5*a* and 5*b*, which reduce turbulence. Optionally, ring 64 can be provided to shield the newly spun fibers from immediate contact with the quench gas. Similarly, shield 74 can be positioned to control quench gas flow. The quench gas and fibers 6 pass through funnel 8, the gas velocity accelerating as it does so. Additional gas can be drawn in between the bottom of funnel 8 and the top 39 of tube 35, and optionally gas jets 60 can be arranged to supply still more gas, especially along the inside of tube 35 to minimize the risk of fibers 6 touching the inside of tube 35. Tube 35 flares outward at trumpet 58. The shapes of both funnel 8 and trumpet 58 are designed to minimize turbulence. Quench gas velocity is reduced when it enters chamber 43 and further reduced when it enters chamber 49, thus reducing the risk of turbulence. Perforated cylinder 47 further assists in reducing turbulence. Increased control of quench gas velocity can be attained by various means, for example by use of valve 53, throttle 55, and velocimeter 57. Fibers 6 leave this part of the apparatus through exit 7, pass by optional finish roll 10, and can then be additionally processed, for example by means of the roll and jet systems illustrated in FIGS. 3, 7, and 9. Optionally, ceramic fiber guides 46 can be provided at exit 7.

The speed of feed rolls 13 determines and is substantially equal to the withdrawal speed. When crossflow, radial flow or the like flow of gas is used, the withdrawal speed can be in the range of about 700–3,500 meters per minute, commonly about 1,000–3,000 meters per minute. When co-current quench gas flow is used, the withdrawal speed can be in the range of about 820–4,000 meters per minute, typically about 1,000–3,000 meters per minute.

The bicomponent fiber can then be heated and drawn, for example, by heated draw rolls, draw jet or by rolls in a hot chest. It can be advantageous to use both hot draw rolls and a steam draw jet, especially when highly uniform fibers having a linear density of greater than 140 dtex are desired. The arrangement of rolls shown in FIG. 3 is the system that was used in Examples 1, 2, and 4 and has been found useful in the present process. However, other roll arrangements and apparatus that accomplish the desired results can also be used (for example, those illustrated in FIGS. 7 and 9). Drawing can be done via a single-stage or two-stage draw. In FIG. 3, fiber 6, which has just been spun for example from the apparatus shown in FIGS. 1, 2, 4, or 6, can be passed by (optional) finish roll 10, around driven roll 11, around idler roll 12, and then around heated feed rolls 13. The temperature of feed rolls 13 can be in the range of about 20° C.–120° C. The fiber can then be drawn by heated draw rolls 14. The temperature of draw rolls 14 can be in the range of about 50–185° C., preferably about 100–120° C. The draw ratio (the ratio of wind-up speed to withdrawal or feed roll speed) is in the range of about 1.4–4.5, preferably about 2.4–4.0. Each of the rolls within pair of rolls 13 can be operated at the same speed as the other roll, as can those within pair 14.

After being drawn by rolls 14, the fiber can be heat-treated by rolls 15, passed around optional unheated rolls 16 (which adjust the yarn tension for satisfactory winding), and then to windup 17. Heat treating can also be carried out with one or more other heated rolls, steam jets or a heating chamber such as a "hot chest" or a combination thereof. The heat-treatment can be carried out at substantially constant length, for example, by rolls 15 in FIG. 3, which can heat the fiber to a temperature in the range of about 140° C.–185° C., preferably about 160° C.–175° C. The duration of the heat-treatment is dependent on yarn denier; what is important is that the fiber can reach a temperature sufficient to result in an after-heat-set contraction value above about 30%. If the heat-treating temperature is too low, crimp can be reduced under tension at elevated temperatures, and shrinkage can be increased. If the heat-treating temperature is too high, operability of the process becomes difficult because of frequent fiber breaks. It is preferred that the speeds of the heat-treating rolls and draw rolls be substantially equal in order to keep fiber tension substantially constant (for example 0.2cN/dtex or greater) at this point in the process and thereby avoid loss of fiber crimp.

An alternative arrangement of rolls and jets is illustrated in FIG. 7. Just-spun bicomponent fiber 6 can be passed by optional primary finish roll 10*a* and optional interlace jet 20*a* and then around feed rolls 13, which can be unheated. The fiber can be drawn through draw jet 21, which can be operated at pressures of 0.2–8.0 bar (2040–81,600 Kg/m) and temperatures of 180° C.–400° C., and both heat-treated and drawn by rolls 14, which can heat the fiber to a temperature of about 140° C.–185° C., preferably about 160° C.–175° C. The draw ratio used can be in the same range as described above for the arrangement shown in FIG. 3. Fiber 6 can then be passed around optional roll 22 (optionally operated at speeds lower than rolls 14 in order to relax the fiber) in preparation for optional interlacing by interlace jet 20*b*, and can be passed around optional roll 16 (to adjust the fiber tension for satisfactory winding), past optional finish roll 10*b*, and finally to windup 17.

Finally, the fiber is wound up. When cross-flow quench gas flow is used, the windup speed is at least about 3,300 meters per minute, preferably at least about 4,000 meters per minute, and more preferably at about 4,500–5,200 meters per minute. When co-current quench gas flow and one quench zone are used, the windup speed is at least about 3,300 meters per minute, preferably at least about 4,500 meters per minute, and more preferably about 5,000–6,100 meters per minute. If co-current quench gas flow and two quench zones are used, the windup speed is at least about 3,300 meters per minute, preferably at least about 4,500 meters per minute and more preferably about 5,000–8,000 meters per minute.

The wound fiber can be of any size, for example 0.5–20 denier per filament (0.6–22 dtex per filament). It has now been found that novel poly(ethylene terephthalate)//poly-(trimethylene terephthalate) fibers of about 0.5–1.5 denier per filament (about 0.6–1.7 dtex per filament) having a side-by-side or eccentric sheath core cross-section and a substantially round, oval, or snowman cross-sectional shape can be made at low, intermediate, or high spinning speeds. For high crimp contraction levels, for example above about 30%, it is preferred that such novel fibers have a weight ratio of poly(ethylene terephthalate) to poly(trimethylene terephthalate) in the range of about 30/70 to 70/30. It was unexpected that such fine fibers could reliably be drawn sufficiently to give such high crimp levels.

When a plurality of fibers of the invention are combined into a yarn, the yarn can be of any size, for example up to 1300 decitex. Any number of filaments, for example 34, 58, 100, 150, or 200, can be spun using the process of the invention.

It was found unexpectedly that highly uniform bicomponent fibers, comprising two polymers that react differently to their environment as indicated by their spontaneous crimp, can be made with a low average decitex(denier) spread of less than about 2.5%, typically in the range of 1.0–2.0%. Uniform fibers are valuable because mill efficiency and processing are improved due to fewer fiber breaks, and fabrics made from such fibers are visually uniform.

The process of the present invention can be operated as a coupled process or as a split process in which the bicomponent fiber is wound up after the withdrawing step and later backwound for the hot-drawing and heat-treating steps. If a split process is used, the next steps are accomplished without excessive delay, typically less than about 35 days and preferably less than about 10 days, in order to achieve the desired bicomponent fiber. That is, the drawing step is completed before the as-spun fiber becomes embrittled due to aging in order to avoid excessive fiber breaks during drawing. Undrawn fiber can be stored refrigerated, if desired, to diminish this potential problem. After the drawing step, the heat-treating step is completed before the drawn fiber relaxes significantly (typically in less than a second).

The weight ratio of the two polyesters in the bicomponent fibers made by the process of the invention is about 30/70–70/30, preferably about 40/60–60/40, and more preferably about 45/55–55/45.

The two polyesters used in the process of the present invention have different compositions, for example 2G-T and 3G-T (most preferred) or 2G-T and 4G-T and preferably have different intrinsic viscosities. Other polyesters include poly(ethylene 2,6-dinaphthalate, poly(trimethylene 2,6-dinaphthalate), poly(trimethylene bibenzoate), poly (cyclohexyl 1,4-dimethylene terephthalate), poly(1,3-cyclobutane dimethylene terephthalate), and poly(1,3-cyclobutane dimethylene bibenzoate). It is advantageous for the polymers to differ both with respect to intrinsic viscosity and composition, for example, 2G-T having an IV of about 0.45–0.80 dl/g and 3G-T having an IV of about 0.85–1.50 dl/g, to achieve an after heat-set crimp contraction value of at least 30%. When 2G-T has an IV of about 0.45–0.60 dl/g and 3-GT has an IV of about 1.00–1.20 dl/g, a preferred composition, after heat-set crimp contraction values of at least about 40% can be achieved. Nevertheless, the two polymers must be sufficiently similar to adhere to each other; otherwise, the bicomponent fiber will split into two fibers.

One or both of the polyesters used in the process of the invention can be copolyesters. For example, a copoly (ethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclo-hexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl) ether, or a poly(ethyleneether) glycol having a molecular weight below about 460, including diethyleneether glycol). The comonomer can be present in the copolyester at levels of about 0.5–15 mole percent.

Isophthalic acid, pentanedioic acid, hexanedioic acid, 1,3-propane diol, and 1,4-butanediol are preferred because they are readily commercially available and inexpensive.

The copolyester(s) can contain minor amounts of other comonomers, provided such comonomers do not have an adverse affect on the amount of fiber crimp or on other properties. Such other comonomers include 5-sodium-sulfoisophthalate, at a level of about 0.2–5 mole percent. Very small amounts of trifunctional comonomers, for example trimellitic acid, can be incorporated for viscosity control.

As wound up, the bicomponent fiber made by the present process exhibits considerable crimp. Some crimp may be lost on the package, but it can be "re-developed" upon exposure to heat in a substantially relaxed state. Final crimp development can be attained under dry heat or wet heat conditions. For example, dry or wet (steam) heating in a tenter frame and wet heating in a jig scour can be effective. For wet heating of polyester-based bicomponent fibers, a temperature of about 190° F. (88° C.) has been found useful. Alternatively, final crimp can be developed by a process disclosed in U.S. Pat. No. 4,115,989, in which the fiber is passed with overfeed through a bulking jet with hot air or steam, then deposited onto a rotating screen drum, sprayed with water, unraveled, optionally interlaced, and wound up.

In the Examples, the draw ratio applied was the maximum possible without generating a significant increase in the number and/or frequency of broken fibers and was typically at about 90% of break-draw. Unless otherwise indicated, rolls 13 in FIG. 3 were operated at about 60° C., rolls 14 at about 120° C. and rolls 15 at about 160° C.

Intrinsic viscosity ("IV") of the polyesters was measured with a Viscotek Forced Flow Viscometer Model Y-900 at a 0.4% concentration at 19° C. and according to ASTM D-4603-96 but in 50/50 wt % trifluoroacetic acid/methylene chloride instead of the prescribed 60/40 wt % phenol/1,1,2,2-tetrachloroethane. The measured viscosity was then correlated with standard viscosities in 60/40 wt % phenol/1,1,2,2-tetrachloroethane to arrive at the reported intrinsic viscosity values. IV in the fiber was measured by exposing polymer to the same process conditions as polymer actually spun into bicomponent fiber except that the test polymer was spun through a sampling spinneret (which did not combine the two polymers into a single fiber) and then collected for IV measurement.

Unless otherwise noted, the crimp contraction in the bicomponent fiber made as shown in the Examples was measured as follows. Each sample was formed into a skein of 5000 +/−5 total denier (5550 dtex) with a skein reel at a tension of about 0.1 gpd (0.09 dN/tex). The skein was conditioned at 70 +/−2° F. (21+/−1° C.) and 65 +/−2% relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as "$C_b$". The 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "$L_b$". Crimp contraction value (percent) (before heat-setting, as described below for this test), "$CC_b$", was calculated according to the formula $$CC_b=100\times(L_b-C_b)/L_b$$

The 500-g weight was removed and the skein was then hung on a rack and heat-set, with the 1.35 mg/dtex weight still in place, in an oven for 5 minutes at about 225° F. (107° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "$L_a$". The after heat-set crimp contraction value (%), "$CC_a$", was calculated according to the formula $$CC_a=100\times(L_a-C_a)/L_a.$$

$CC_a$ is reported in the Tables. After-heat-set crimp contraction values obtained from this test are within this invention and acceptable if they are above about 30% and, preferably, above about 40%.

Decitex Spread ("DS"), a measure of the uniformity of a fiber, was obtained by calculating the variation in mass at regular intervals along the fiber, using an ACW/DVA (Automatic Cut and Weigh/Decitex Variation Accessory) instrument (Lenzing Technik), in which the fiber was passed through a slot in a capacitor which responded to the instantaneous mass of the fiber. The mass was measured every 0.5 m over eight 30-m lengths of the fiber, the difference between the maximum and minimum mass within each of the lengths was calculated and then averaged over the eight lengths, and the average difference divided by the average mass of the entire 240-m fiber length was recorded as a percentage. To obtain "average Decitex Spread", such measurements were made on at least three packages of fiber. The lower the DS, the higher the uniformity of the fiber.

In spinning the bicomponent fibers in Examples 1–4, the polymers were melted with Werner & Pfleiderer co-rotating 28-mm extruders having 0.5–40 pound/hour (0.23–18.1 kg/hour) capacities. The highest melt temperature attained in the 2G-T extruder was about 280–285° C., and the corresponding temperature in the 3G-T extruder was about 265–275° C. Pumps transferred the polymers to the spinning head. In Examples 1–4, the fibers were wound up with a Barmag SW6 2s 600 winder (Barmag AG, Germany), having a maximum winding speed of 6,000 meters per minute.

The spinneret used in Examples 1–4 was a post-coalescence bicomponent spinneret having thirty-four pairs of capillaries arranged in a circle, an internal angle between each pair of capillaries of 30°, a capillary diameter of 0.64 mm, and a capillary length of 4.24 mm. Unless otherwise noted, the weight ratio of the two polymers in the fiber was 50/50. Total yarn decitex in Examples 1 and 2 was about 78.

EXAMPLE 1

A. 1,3-Propanediol ("3G") was prepared by hydration of acrolein in the presence of an acidic cation exchange catalyst, as disclosed in U.S. Pat. No. 5,171,898, to form 3-hydroxypropionaldehyde. The catalyst and any unreacted acrolein were removed by known methods, and the 3-hydroxypropionaldehyde was then catalytically hydrogenated using a Raney Nickel catalyst (for example as disclosed in U.S. Pat. No. 3,536,763). The product 1,3-propanediol was recovered from the aqueous solution and purified by known methods.

B. Poly(trimethylene terephthalate) was prepared from 1,3-propanediol and dimethylterephthalate ("DMT") in a two-vessel process using tetraisopropyl titanate catalyst, Tyzor® TPT (a registered trademark of E. I. du Pont de Nemours and Company) at 60 ppm, based on polymer. Molten DMT was added to 3G and catalyst at 185° C. in a transesterification vessel, and the temperature was increased to 210° C. while methanol was removed. The resulting intermediate was transferred to a polycondensation vessel where the pressure was reduced to one millibar (10.2 kg/cm$^2$), and the temperature was increased to 255° C. When the desired melt viscosity was reached, the pressure was increased and the polymer was extruded, cooled, and cut into pellets. The pellets were further polymerized in a solid-phase to an intrinsic viscosity of 1.04 dl/g in a tumble dryer operated at 212° C.

C. Poly(ethylene terephthalate) (Crystar® 4415, a registered trademark of E. I. du Pont de Nemours and Company), having an intrinsic viscosity of 0.54 dl/g, and poly (trimethylene terephthalate), prepared as in step B above, were spun using the apparatus of FIG. 2. The spinneret temperature was maintained at about 272° C. In the spinning apparatus, the internal diameter of cylindrical screen 5 was 4.0 inches (10.2 cm), the length B of screen 5 was 6.0 inches (15.2 cm), the diameter of cone 8 at its widest was 4.0 inches (10.2 cm), the length of cone C2 was 3.75 inches (9.5 cm), the length of tube C3 was 15 inches (38.1 cm), the distance C1 was 0.75 inch (1.9 cm). The inner diameter of tube 8 was 1.0 inch (2.5 cm), and the (post-coalescence) spinneret was recessed into the top of the spinning column by 4 inches (10.2 cm) ("A" in FIG. 2) so that the quench gas contacted the just-spun fibers only after a delay. The quench gas was air, supplied at a room temperature of about 20° C. The fibers had a side-by-side cross-section and an oval cross-sectional shape.

About 10 wraps were taken around the heat-treating rolls.

TABLE I

| Sample | Air Speed (1) (mpm) | Withdrawal Speed (mpm) | Air Speed/ Withdrawal Speed | Draw Ratio | Windup Speed (mpm) | $CC_a$ (%) |
|---|---|---|---|---|---|---|
| 1 | 560 | 875 | 0.6 | 4.0 | 3500 | 51 |
| 2 | 560 | 1000 | 0.6 | 4.0 | 4000 | 55 |
| 3 | 560 | 1125 | 0.6 | 4.0 | 4500 | 57 |
| 4 | 1141 | 1250 | 0.9 | 4.0 | 4975 | 54 |
| 5 | 906 | 1250 | 0.7 | 4.0 | 5000 | 54 |
| 6 | 1141 | 1336 | 0.9 | 3.7 | 4975 | 54 |
| 7 | 1472 | 1388 | 1.1 | 3.6 | 4940 | 51 |
| 8 | 1472 | 1571 | 0.9 | 3.5 | 5440 | 51 |
| 9 | 1695 | 1714 | 1.0 | 3.5 | 5930 | 44 |

(1) In the 2.54-cm inner diameter tube fiber exit

Figure 5:
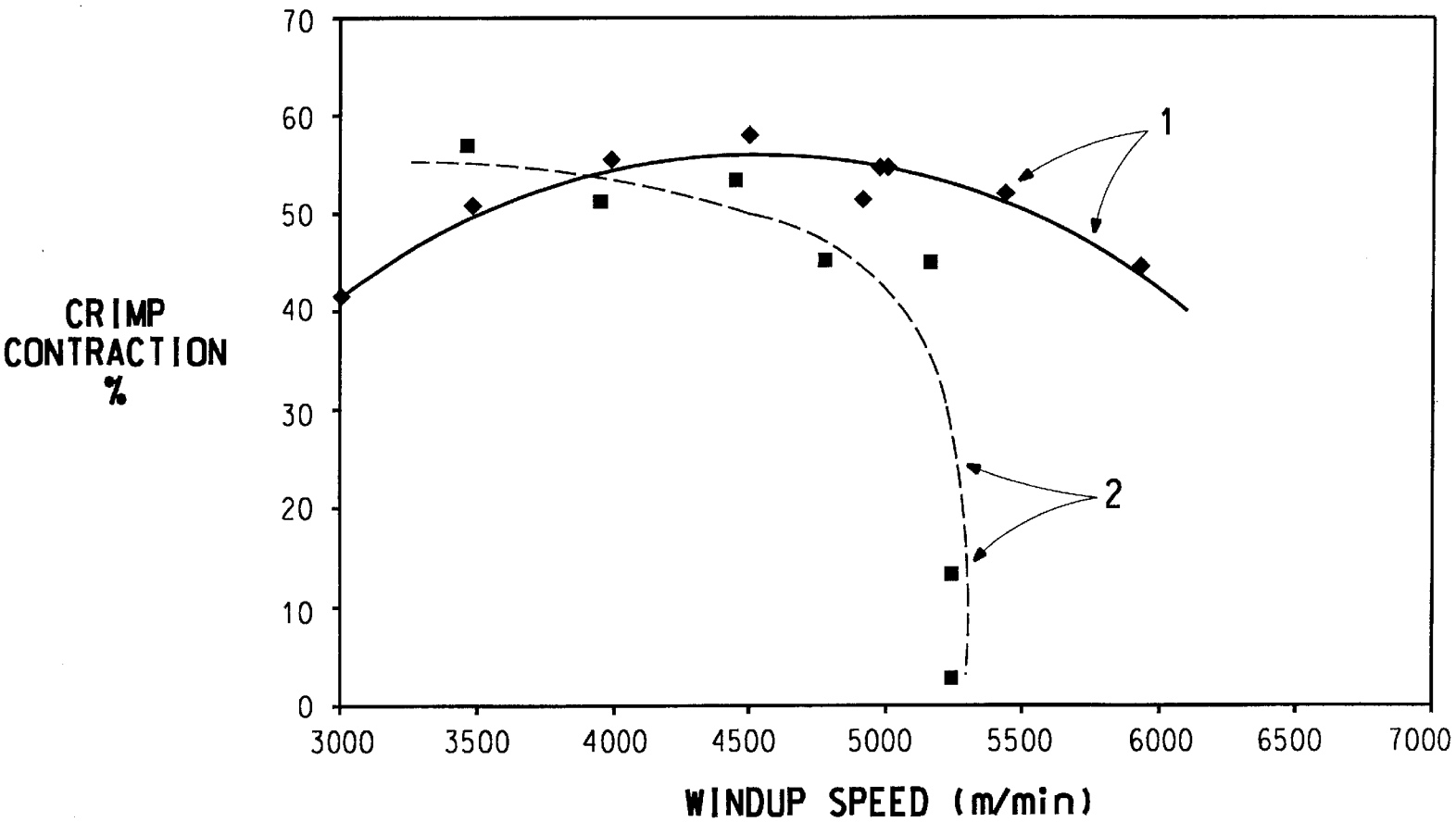
FIG. 5 is a graphical representation of the relationship between fiber crimp contraction ("$CC_a$") and windup speed for Examples 1 and 2.

The data show that good crimp can be attained at high withdrawal and windup speeds using the process of the invention and two polyesters. The data also suggest that windup speeds of up to at least about 6,100 meters per minute can be successfully used in the present co-current gas flow process when one co-current quench zone is used (see curve "1" in FIG. 5, which shows an apolation of windup speed).

EXAMPLE 2

Crystar® 4415 and poly(trimethylene terephthalate) as prepared in Example 1 were spun into a side-by-side oval bicomponent fiber using the cross-flow quench apparatus of FIG. 1. The spinneret temperature was maintained at about 272° C. For samples 10–15, the (post-coalescence) spinneret was recessed into the top of the spinning column by six inches (15.2 cm) ("A" in FIG. 1). The height of the zone below the spinneret ("2" in FIG. 1 was 172 cm. For samples 10–13, the flow of quench air had the following profile, measured 5 inches (12.7 cm) from screen 5 (see FIG. 1):

| Distance below spinneret (cm) | Air speed (mpm) |
|---|---|
| 15 | 8.5 |
| 30 | 9.4 |
| 46 | 9.4 |
| 61 | 11.0 |
| 76 | 11.0 |
| 91 | 11.3 |
| 107 | 11.6 |
| 122 | 16.5 |
| 137 | 34.1 |
| 152 | 39.6 |
| 168 | 29.6 |

For samples 14 and 15, the quench air velocity was approximately 50% higher.

For samples 16 and 17, no recess (no heated quench delay space) was used, and the quench air flow had the following profile, also measured 5 inches (12.7 cm) from screen 5:

| Distance below spinneret (cm) | Air speed (mpm) |
|---|---|
| 2.5 | 15.2 |
| 30.5 | 12.2 |
| 61.0 | 11.3 |
| 91.4 | 9.8 |
| 121.9 | 9.8 |
| 152.4 | 9.8 |

Properties of the resulting fibers are given in Table II and illustrated as curve "2" in FIG. 2. The data show that high crimp levels can be obtained at surprisingly high speeds with crossflow quench gas. Above about 3,500 mpm feed roll speed (withdrawal speed), fiber breaks prevented the application of sufficient draw to attain high crimp contraction levels.

TABLE II

| Sample | Withdrawal Speed (mpm) | Draw Ratio | Windup Speed (mpm) | $CC_a$ (%) |
|---|---|---|---|---|
| 10 | 750 | 4.0 | 2980 | 56 |
| 11 | 933 | 3.7 | 3470 | 57 |
| 12 | 1176 | 3.4 | 3960 | 51 |
| 13 | 1406 | 3.2 | 4455 | 53 |
| 14 | 2000 | 2.4 | 4750 | 45 |
| 15 | 3250 | 1.6 | 5150 | 45 |
| 16 | 4417 | 1.2 | 5250 | 13 |
| 17 | 4818 | 1.1 | 5270 | 2 |

EXAMPLE 3

Using the same spinning equipment as employed in Example 1, poly(ethylene terephthalate) and poly (trimethylene terephthalate), prepared as in Example 1, side-by-side oval cross-section bicomponent yarns of 34 filaments and 49–75 dtex (1.4–2.2 dtex per filament) were spun at withdrawal speeds of 2,800–4,500 meters per minute. The fibers were wound up on bobbins without drawing. The fibers were stored at room temperature (about 20° C.) for about three weeks and at about 5° C. for about fifteen days, after which they were drawn over a 12-inch (30 cm) hot shoe held at 90° C. at a feed roll speed of 5–10 meters per minute and heat-treated by passing them at constant length through a 12-inch (30 cm) glass tube oven held at 160° C. The fibers were drawn at 90% of the draw at which they broke. In this Example, crimp contraction levels were measured immediately after drawing and heat-treating by hanging a loop of fiber from a holder with a 1.5 mg/denier (1.35 mg/dtex) weight attached to the bottom of the loop and measuring the length of the loop. Then a 100 mg/den (90 mg/dtex) weight was attached to the bottom of the loop, and the length of the loop was measured again. Crimp contraction was calculated as the difference between the two lengths, divided by the length measured with the 90 mg/dtex weight. This method gives crimp contraction values up to about 10% (absolute) higher than the method described for "$CC_a$" so that values above about 40% are acceptable. Results are summarized in Table III.

TABLE III

| Sample | Air Speed (1) (mpm) | Withdrawal Speed (mpm) | Air Speed/ Withdrawal Speed | Draw Ratio | Crimp Contraction (%) |
|---|---|---|---|---|---|
| 18 | 1200 | 2800 | 0.43 | 2.0 | 50 |
| 19 | 1515 | 3500 | 0.43 | 1.6 | 42 |
| 20 | 1712 | 4000 | 0.43 | 1.4 | 51 |
| 21 | — | 4500 | — | 1.2 | 19 |

(1) In the 2.54 cm inner diameter tube fiber exit

The results showed that, after spinning, drawing can be delayed by about five weeks (for example, in a split process) and still be effective in generating crimp in bicomponent fibers spun with co-current air flow and that useful crimp levels can be attained with draw ratios as low as about 1.4.

EXAMPLE 4

The same apparatus and polymers as in Example 1 were used, but with an unheated quench delay space (created by an unheated cylinder coaxial with the spinneret) of 2 inches (5.1 cm). The withdrawal speed was 2,000 m/min, the draw ratio was 2.5–2.6, and the windup speed was 5,000–5,200 m/min. Oval side-by-side bicomponent fibers were produced with single superatmospheric quench zone pressures so that the corresponding air speeds at exit 7 of tube 8 (see FIG. 2) were 1141 m/min and 1695 m/min, respectively. The resulting 2G-T//3G-T bicomponent yarns of 34 filaments and 42 decitex (38 denier) [1.1 denier (1.2 dtex) per filament] had unexpectedly high crimp contraction ("CCa") levels, 49–62%, which were comparable to crimp levels obtained in Example 1 for filament of nearly twice the dtex/filament. At this low decitex, higher speeds were not possible with this apparatus geometry and process conditions, due to breaks in the fibers during drawing and heat-treating and on the wound package. However, when the cylinder creating the 2-inch (5.1 cm) quench delay space was heated with a band heater at 250° C. and the position of tube 8 (see FIG. 2) was raised so that distance "C1" in FIG. 2 was reduced substantially to zero, even finer 2G-T//3G-T bicomponent yarns of 38 decitex (34 denier) and 34 filaments [1.0 denier(1.1 dtex)

per filament] and having good crimp contraction ("CCa") levels (40–49%) were produced at up to 5,700 m/min with a draw ratio of 2.85. Thus, heating the quench delay space and shortening the quench zone improved high speed process continuity for very fine polyester bicomponent fibers. Knit and woven and woven fabrics prepared from these filaments had a very soft hand.

EXAMPLE 5

This example illustrates the use of a two-zone co-current quench under a variety of conditions. In each of Examples 5A, 5B, and 5C, poly(ethylene terephthalate) (Crystar® 4415-675) having an intrinsic viscosity of 0.52 dl/g, and poly(trimethylene terephthalate) prepared as in step B of example 1, were spun into 34 side-by-side bicomponent filaments using the spinning apparatus of FIG. 4 and the roll-and-jet arrangement of FIG. 7. The extruder used for 2G-T was a single-screw Barmag model 4E10/24D with a 4E4-41-2042 model screw. The extruder used for 3G-T was a single-screw Barmag Maxflex (single zone heating, 30 mm internal diameter) with a MAF30-41-3 model single flight screw. The residence times in the transfer lines between the extruder discharge and the spinneret face were measured by adding briefly dye chips to the polymers and determining the time it took for the dye to appear in, and then disappear from, the fiber. For the 2G-T line, the appearance time was 6½ minutes, and the disappearance time was over 40 minutes. For the 3G-T line, the appearance time was 4¾ minutes, and the disappearance time was 10 minutes. The poly(trimethylene terephthalate) was discharged from the extruder at a temperature less than about 260° C. and the transfer line was at about the same temperature. The angle between the capillaries in the post-coalescence spinneret was 30°, and the distance between the capillaries at their exits was 0.067 mm. The pre-coalescence spinneret had a combined capillary and counterbore length of 16.7 mm. The quench gas entered the spinning column at least 90 mm below the spinneret ("A" in FIG. 4) so that the gas first contacted the just-spun fibers only after a delay; the recess was not intentionally heated. The quench gas was air, supplied at a temperature of 20° C. and a relative humidity of 65%. The minimum inner diameter of tube 8*a* was 0.75 inch (1.91 cm) and the minimum inner diameter of tube 8*b* was 1.5 inch (3.81 cm). Five-and-a-half wraps were taken around unheated feed rolls 13. Draw jet 21 was operated at 0.6 bar (6118 Kg/cm$^2$) and 225° C., and the steam flow was adjusted to control the position of the drawpoint. Draw rolls 14 also functioned as heat-treating rolls and were operated at 180° C.; five-and-a-half wraps were taken around these rolls, too. The winder was a commercial Barmag CRAFT 8-end winder capable of 7000 m/min winding speed. The fibers had a side-by-side cross-section, and the total yarn denier was 96 in Examples 5A and 5C and 108 in Example 5B (107 decitex and 120 decitex, respectively). Other spinning conditions and the cross-sectional shapes and crimp contraction levels are summarized in Table IV.

TABLE IV

| Example | 5A | 5B | 5C |
|---|---|---|---|
| Polymer Weight Ratio (2G-T//3G-T) | 60/40 | 50/50 | 45/55 |
| 2G-T Transfer Line(° C. | 278 | 263 | 278 |
| Spinneret Type | Post-Coalescence | Pre-Coalescence | Post-Coalescence |
| Spin Block(° C.) | 278 | 263 | 278 |

TABLE IV-continued

| Example | 5A | 5B | 5C |
|---|---|---|---|
| 1st Quench Zone Max. Air Speed (m/min) | 3180 | 3180 | 3180 |
| 2nd Quench Zone Max. Air Speed (m/min) | 2152 | 2184 | 2152 |
| Feed Rolls 13 Speed (m/min) | 2715 | 2100 | 2870 |
| Draw Rolls 14 Speed (m/min) | 6810 | 6835 | 6833 |
| Draw Ratio | 2.5 | 3.2 | 2.4 |
| Roll 22 Speed (mpm) | 6810 | 6835 | 6833 |
| Roll 16 Speed (mpm) | 6770 | 6775 | 6793 |
| Winder 17 Speed (mpm) | 6702 | 6710 | 6700 |
| Fiber Cross-sectional Shape | Snowman | Round | Snowman |
| $CC_a$, % | 55 | 67 | 58 |

The decitex spread for Example 5B, based on data from a single package, was 1.36%. The data in Table IV show that very high crimp levels can be attained at very high speeds by using the process of the invention.

EXAMPLE 6

This example relates to novel, highly uniform bicomponent fibers comprising poly(ethylene terephthalate) and poly (trimethylene terephthalate). The polymers, extruders, spinning apparatus, spinneret recess, quench gas, winder, and roll-and-jet arrangement used were the same as in Example 5. The post-coalescence spinneret of Example 5 was used, and the fiber cross-sectional shape in each case was "snowman". The temperature of the poly(trimethylene terephthalate) as it left the extruder was less than about 260° C., and the transfer line was at about the same temperature. The recess was not intentionally heated except in Example 6.C, in which it was heated to 120° C. Feed rolls 13 were not intentionally heated except in Example 6.B., in which they were heated to 55° C. The steam flow in draw jet 21 was adjusted to control the location of the drawpoint. Draw rolls 14 also functioned as heat-treating rolls and were again operated at 180° C. Five-and-a-half wraps were taken around the feed rolls and draw rolls. Other spinning conditions and crimp contraction levels are given in Table V. Decitex Spread data are presented in Table VI.

TABLE V

| Example | 6A | 6B | 6C |
|---|---|---|---|
| Decitex | 174 | 172 | 82 |
| Number of filaments | 68 | 34 | 34 |
| Polymer Weight Ratio (2G-T//3-GT) | 60/40 | 50/50 | 50/50 |
| 2G-T transferline (Dowtherm temp. ° C.) | 264 | 262 | 280 |
| Spin block (Dowtherm temp., ° C.) | 264 | 262 | 280 |
| 1st Quench Zone Max. Air Speed (m/min) | 3079 | 3180 | 2980 |
| 2nd Quench Zone Max. Air Speed (m/min) | 1895 | 2184 | 1766 |
| Steam draw jet pressure (kg/m$^2$) | 7134 | 29,572 | 5099 |
| Steam draw jet temp. ( ° C.) | 237 | 240 | 224 |
| Feed Rolls 13 speed (m/min) | 1915 | 2140–2210 | 1300–1380 |
| Draw Rolls 14 speed (m/min) | 6123 | 6845 | 4300 |
| Draw Ratio | 3.2 | 3.1–3.2 | 3.1–3.3 |
| Roll 22 Speed (m/min) | 6123 | 6845 | 4300 |
| Roll 16 Speed (m/min) | 6081 | 6775 | 4275 |
| Winder 17 Speed (m/min) | 6001 | 6710 | 4200 |
| Crimp Contraction ("$CC_a$"), % | 57 | 55 | 56 |

TABLE VI

| Example | Package | DS (%) |
|---|---|---|
| 6A | 1 | 1.8 |
| | 2 | 2.2 |
| | 3 | 2.0 |
| | 4 | 2.1 |
| | 5 | 1.9 |
| | Average | 2.0 |
| 6B | 1 | 1.9 |
| | 2 | 2.1 |
| | 3 | 1.8 |
| | Average | 1.9 |
| 6C | 1 | 1.3 |
| | 2 | 1.8 |
| | 3 | 1.7 |
| | 4 | 1.8 |
| | Average | 1.6 |

EXAMPLE 7

Comparison

This Example shows what levels of uniformity can be obtained using conventional cross-flow quench in making polyester bicomponent fibers. Poly(trimethylene terephthalate) containing 0.3wt % TiO2 and prepared as described in Example 1 but having an IV of 1.02–1.06, and poly(ethylene terephthalate) (Crystar® 4415, IV 0.52) were used. The polymers were melted in independent extruders and separately transported to a pre-coalescence spinneret at a melt temperature of 256° C. (3G-T) or 285° C. (2G-T). In the fibers, the 3G-T IV was about 0.93, and the 3G-T IV was about 0.52. The weight ratio of 2G-T to 3G-T was 41/59. The extruded bicomponent multifilament yarn was cooled in a cross flow quench unit using an air speed of 16 m/min, supplied from a plenum through a vertical diffuser screen. The roll-and-jet arrangement of FIG. 9 was used. 5 wt % (based on fiber) of an ester-based finish was applied 2 meters below spinneret face 3 (see FIG. 9) by an applicator not shown. Yarn 6 was passed 2.5 times around feed roll 13 and associated separator roll 13*a,* through steam draw jet 21 (operated at 180° C.) and then around draw roll 14 and associated separator roll 14*a.* The yarn was then drawn a second time between draw roll 14 and pair of rolls 15 in hot chest 76, which was heated to 170° C. A total of 7.5 wraps were taken around the two hot chest rolls. The yarn was passed around roll 22, through dual interlace jets 20, and then around roll 16. The same finish was reapplied at finish applicator 10, again at the same 5wt %. Finally, the yarn was wound onto a paper core tube at windup 17. The roll and windup speeds (in meters/minute) are summarized in Table VII, and the resulting average Decitex Spreads are reported in Table VIII.

TABLE VII

| Example | 7A | 7B | 7C |
|---|---|---|---|
| Yarn decitex | 167 | 167 | 83 |
| Number of filaments | 68 | 34 | 34 |
| Speeds, m/min: | | | |
| Feed roll 13 | 840 | 325 | 840 |
| Draw roll 14 | 2560 | 1052 | 2560 |
| Hot chest rolls 15 | 3110 | 1495 | 3110 |
| Roll 22 | 2970 | 1480 | 2970 |
| Roll 16 | 2912 | 1429 | 2912 |
| Windup 17 | 2876 | 1413 | 2876 |
| Total draw ratio | 3.7 | 4.6 | 3.7 |

TABLE VIII

| Example | Package | DS (%) |
|---|---|---|
| 7A | 1 | 2.2 (1) |
| | 2 | 3.1 |
| | 3 | 2.9 |
| | 4 | 2.9 |
| | 5 | 3.2 |
| | 6 | 3.0 |
| | Average | 2.9 |
| 7B | 1 | 3.9 |
| | 2 | 2.9 |
| | 3 | 3.7 |
| | 4 | 3.4 |
| | 5 | 3.6 |
| | 6 | 2.6 |
| | Average | 3.3 |
| 7C | 1 | 3.5 |
| | 2 | 2.7 |
| | 3 | 3.0 |
| | 4 | 2.8 |
| | 5 | 3.0 |
| | Average | 3.0 |

(1) The decitex spread for Example 7A, Package 1 is a statistical outlier and believed not to be representative of the true value of decitex spread in polyester bicomponent fibers obtained with conventional quench methods, as evidenced by the high average Decitex Spread obtained in Example 7A.

Comparison of the results for Examples 6 and 7 shows that unusually uniform 2G-T//3G-T bicomponent fibers can now be made.

What is claimed is:

1. A process for preparing fully drawn crimped bicomponent fibers, having after-heat-set crimp contraction values above 30%, comprising the steps of:

(A) providing two compositionally different polyesters;

(B) melt-spinning the two polyesters from a spinneret to form at least one bicomponent fiber;

(C) providing at least one flow of gas to at least one quench zone below the spinneret and accelerating the gas flow to a maximum velocity in the direction of fiber travel;

(D) passing the fiber through said zone(s);

(E) withdrawing the fiber at a withdrawal speed such that the ratio of the maximum gas velocity to the withdrawal speed is so chosen to achieve a specific draw ratio range;

(F) heating and drawing the fiber at a temperature of 50–185° C. at a draw ratio of about 1.4–4.5;

(G) heat-treating the fiber by heating it to a temperature sufficient to result in an after-heat-set contraction value above 30%; and (H) winding up the fiber at a speed of at least about 3,300 meters per minute.

2. The process of claim 1 wherein the weight ratio of the polyesters is about 30/70 to 70/30, the fiber has a side-by-side or eccentric sheath core cross-section, and wherein the fiber is withdrawn at a speed of about 820–4,000 meters per minute, heated to a temperature of 100–175° C. and drawn, and heat-treated by heating it to a temperature of about 140–185° C.

3. The process of claim 2 wherein the draw ratio is about 2.4–4.0, and the fiber is heat-treated by heating it to a temperature of about 160–175° C., and wound up at a speed of at least about 4,500 meters per minute.

4. The process of claim 1 wherein the two polyesters are poly(trimethylene terephthalate) and a polyester selected from the group consisting of poly(ethylene terephthalate) and a copolyester of poly(ethylene terephthalate), the weight ratio of the polyesters is about 30/70 to 70/30, the fiber has a side-by-side cross-section, and the fiber is withdrawn at a speed of about 1,000–3,000 meters per minute, heat-treated by heating it to a temperature of about 140–185° C., and wound up at a speed about 5,000–6,100 meters per minute.

5. The process of claim 1 wherein gas is supplied to the quench zone at superatmospheric pressure, the weight ratio of the polymers is about 40/60 to 60/40, and steps (F) and (G) are combined and carried out at a temperature of about 140–185° C.

6. The process of claim 1 wherein the two polyesters are poly(trimethylene terephthalate) and a polyester selected from the group consisting of poly(ethylene terephthalate) and a copolyester of poly(ethylene terephthalate), gas is supplied to two quench zones at superatmospheric pressure and the weight ratio of the polymers is 40/60 to 60/40, and the fiber is heat-treated by heating it to a temperature of about 140–185° C. and wound up at a speed of about 5,000–8,000 meters/minute.

7. The process of claim 6 wherein the selected polyester is a copoly(ethylene terephthalate) in which a comonomer used to make the copolyester is selected from the group consisting of:

linear, cyclic, and branched aliphatic dicarboxylic acids having 4–12 carbon atoms;

aromatic dicarboxylic acids having 8–12 carbon atoms;

linear, cyclic, and branched aliphatic diols having 3–8 carbon atoms; and aliphatic and araliphatic ether glycols having 4–10 carbon atoms.

8. The process of claim 7 wherein the comonomer is selected from the group consisting of isophthalic acid, pentanedioic acid, hexanedioic acid, dodecanedioic acid, 1,4-cyclohexanedicarboxylic acid, 1,3-propane diol, and 1,4-butanediol and is present in the copolyester at a level of about 0.5–15 mole percent and the fiber is heat-treated by heating it to a temperature of about 160–175° C.

9. The process of claim 1 wherein the quench gas is accelerated in the direction of fiber travel utilizing subatmospheric pressure in a quench zone below the spinneret.

10. A process for preparing fully drawn crimped bicomponent fibers, having after-heat-set crimp contraction values above 30%, comprising the steps of:

(A) providing two compositionally different polyesters in a weight ratio of about 30/70 to 70/30;

(B) melt-spinning the two polyesters from a spinneret to form at least one bicomponent fiber having a side-by-side or eccentric sheath-core cross-section;

(C) providing a first and second flow of gas to first and second quench zones at superatmospheric pressure below the spinneret;

(D) combining the gas flows in the second quench zone;

(E) passing the fiber through the first and second quench zones;

(F) accelerating the gas flow to a maximum velocity in the direction of fiber travel;

(G) withdrawing the fiber at a withdrawal speed of about 820–4,000 meters per minute such that the ratio of the maximum velocity of the gas to the withdrawal speed is so chosen to achieve a specific draw ratio range;

(H) heating the fiber to a temperature of 50–185° C. and drawing it at a draw ratio of about 1.4–4.5;

(I) heat-treating the fiber at substantially constant length by heating it to a temperature sufficient to result in an after-heat-set contraction value above about 30%; and (J) winding up the fiber at a speed of at least about 3,300 meters per minute.

11. The process of claim 10 wherein the two polyesters are poly(trimethylene terephthalate) having an IV of 0.85–1.50 dl/g and a polyester having an IV of 0.45–0.80 dl/g selected from the group consisting of poly(ethylene terephthalate) and a copolyester of poly(ethylene terephthalate), the draw ratio is about 2.4–4.0, and the fiber is heat-treated by heating it to a temperature of about 140° C.–185° C. and wound up at a speed of at least about 4,500 meters per minute.

12. The process of claim 11 wherein a comonomer utilized to make the copolyester is selected from the group consisting of isophthalic acid, pentanedioic acid, hexanedioic acid, dodecanedioic acid, 1,4-cyclohexanedicarboxylic acid, 1,3-propane diol, and 1,4-butanediol and is present in the copolyester at a level of 0.5–15 mole percent, and the fiber is wound up at a speed of about 5,000–8,000 meters per minute.

13. A process for preparing fully drawn crimped bicomponent fibers, having after-heat-set crimp contraction values above about 30%, comprising the steps of:

(A) providing poly(trimethylene terephthalate) and a polyester selected from the group consisting of poly (ethylene terephthalate) and a copolyester of poly (ethylene terephthalate) having different intrinsic viscosities;

(B) melt-spinning the two polyesters from a spinneret to form at least one bicomponent fiber having a side-by-side or eccentric sheath core cross-section;

(C) providing a flow of gas to a quench zone below the spinneret;

(D) passing the fiber through the quench zone;

(E) withdrawing the fiber;

(F) heating the fiber to a temperature of 50–185° C. and drawing it at a draw ratio of about 1.4–4.5;

(G) heat-treating the fiber by heating it to a temperature sufficient to result in an after-heat-set contraction value above about 30%; and (H) winding up the fiber at a speed of at least about 3,300 meters per minute.

14. The process of claim 13 wherein the weight ratio of the selected polyester and poly(trimethylene terephthalate) is about 30/70 to 70/30, the flow of gas is cross-flow, and the fiber is withdrawn at a speed of about 700–3,500 meters per minute, heat-treated by heating it to a temperature of about 140–185° C., and wound up at a speed of at least about 4,000 meters per minute.

15. The process of claim 13 wherein the weight ratio of the selected polyester and poly(trimethylene terephthalate) is about 40/60 to 60/40, and the fiber is withdrawn at a speed of about 1,000–3,000 meters per minute, drawn at a draw ratio of about 2.4–4.0, heat-treated by heating it to a temperature of about 140–185° C., and wound up at a speed of about 4,500–5,200 meters per minute.

16. The process of claim 13 wherein the selected polyester has an intrinsic viscosity of about 0.45–0.80 dl/g, poly (trimethylene terephthalate) has an intrinsic viscosity of about 0.85–1.50 dl/g, and the fiber has a side-by-side cross-section and a cross-sectional shape selected from the group consisting of snowman, oval, and substantially round.

17. The process of claim 13 wherein the bicomponent fibers have after-heat-set crimp contraction values above 40%, and wherein the intrinsic viscosities of the two polyesters are 0.45–0.60 dl/g and 1.00–1.20 dl/g, respectively.

18. The process of claim 13 wherein a comonomer utilized to make the copolyester is selected from the group consisting of:

linear, cyclic, and branched aliphatic dicarboxylic acids having 4–12 carbon atoms;

aromatic dicarboxylic acids having 8–12 carbon atoms;

linear, cyclic, and branched aliphatic diols having 3–8 carbon atoms; and aliphatic and araliphatic ether glycols having 4–10 carbon atoms.

19. The process of claim 18 wherein the comonomer is selected from the group consisting of isophthalic acid, pentanedioic acid, hexanedioic acid, dodecanedioic acid, 1,4-cyclohexanedicarboxylic acid, 1,3-propane diol, and 1,4-butanediol and is present in the copolyester at a level of about 0.5–15 mole percent, and the fiber is heat-treated by heating it to about 160–175° C.

* * * * *